US005284727A

United States Patent [19]

Itakura et al.

[11] Patent Number: 5,284,727

[45] Date of Patent: Feb. 8, 1994

[54] ELECTROPHOTOGRAPHIC ELEMENT WITH ALUMITE LAYER

[75] Inventors: Takayuki Itakura, Moriguchi; Youichi Takesawa, Suita, both of Japan

[73] Assignee: Mita Industrial Co., Ltd., Osaka, Japan

[21] Appl. No.: 810,852

[22] Filed: Dec. 20, 1991

[30] Foreign Application Priority Data

Dec. 21, 1990 [JP] Japan ..... 2-405224

[51] Int. Cl.[5] ..... G03G 5/14

[52] U.S. Cl. ..... 430/58; 430/60; 430/65

[58] Field of Search ..... 430/58, 60, 65

[56] References Cited

U.S. PATENT DOCUMENTS 4,800,144 1/1989 Ueda et al. ..... 430/65 X
5,162,185 11/1992 Fukuda et al. ..... 430/65 X

FOREIGN PATENT DOCUMENTS 116161 5/1988 Japan ..... 430/65
280768 11/1989 Japan ..... 430/60
242264 9/1990 Japan ..... 430/65

*Primary Examiner*—Roland Martin
*Attorney, Agent, or Firm*—Sherman and Shalloway

[57] ABSTRACT

Disclosed is an organic highly photosensitive material used for copying machines based on electrophotographic method. The photosensitive material has a high developing sensitivity even using the same developing agent and the same developing system, and makes it possible to form images having high density and high contrast. The organic highly photosensitive material comprises an aluminum substrate having a surface-treated layer and an organic photosensitive layer formed thereon, wherein the surface-treated layer of the aluminum substrate has an impedance Z that lies within a predetermined range.

16 Claims, 5 Drawing Sheets

ELECTROPHOTOGRAPHIC ELEMENT WITH ALUMITE LAYER

BACKGROUND OF THE INVENTION (1) Field of the Invention

The present invention relates to a photosensitive material for electrophotography having an organic photosensitive layer formed on an aluminum substrate of which the surface has been treated, and more particularly to an organic photosensitive material having improved developing sensitivity.

(2) Description of the Related Art

Photosensitive materials for electrophotography which are widely used are obtained by forming various inorganic or organic photoconductive layers on an electrically conductive substrate. Among such organic photosensitive materials, there has been known a so-called function-separation type photosensitive material based on the combination of a charge-generating substance and a charge-transporting substance in a laminated form or in a dispersed form.

Commercially, a drum of aluminum has in many cases been used as an electrically conductive substrate for forming an organic photosensitive material. To accomplish intimate adhesiveness with respect to the organic photosensitive layer, the surface of the drum made of aluminum is usually subjected to the anodic oxidation treatment or so-called Alumite treatment.

In the electrophotographic system of either the analog type or the digital type, in general, it is desired to employ a developing system having a high developing sensitivity, i.e., having a large $\gamma$ (gamma) value in order to reproduce high-contrast images such as characters. Here, the $\gamma$ value is defined as an inclination when a relationship is plotted between the image concentration which is represented by an ordinate and an electrostatic latent image potential (or a bias potential) represented by an abscissa.

In the conventional electrophotographic method, the $\gamma$ value varies depending upon the constitution and characteristics of the photosensitive layer, as a matter of course. When the photosensitive layer is constant, it has been known that the $\gamma$ value varies depending upon the characteristics of the developing agent or the conditions of the developing system.

SUMMARY OF THE INVENTION

In conducting experiments for forming predetermined organic photosensitive layer on a drum made of aluminum, the present inventors have unexpectedly found that the developing sensitivity $\gamma$ often varies under the same developing conditions even though the photosensitive materials that are prepared have almost the same constitution and electric characteristics.

In a step of solving this trouble, the present inventors have discovered the fact that the impedance characteristics of the anodically oxidized film that exists on the surface of the aluminum substrate greatly affect the developing sensitivity, i.e., $\gamma$-value of the organic photosensitive material, and have arrived at the present invention.

That is, the object of the present invention is to provide a photosensitive material for electrophotography which comprises a surface-treated aluminum substrate and an organic photosensitive layer formed thereon, and which exhibits improved developing sensitivity.

Another object of the present invention is to provide an organic photosensitive material for electrophotography which is capable of forming toner images having a high density and a high contrast without much affected by the kinds of the developing agents or the developing system.

According to the present invention, there is provided an organic highly photosensitive material for electrophotography comprising an aluminum substrate having a surface-treated layer and an organic photosensitive layer formed on the surface-treated layer, wherein said aluminum substrate has on the surface thereof said surface-treated layer having electric characteristics that satisfy equations, $$Z2 \geqq 300 \quad (1)$$

and $$Z2/Z3 \geqq 3$$

wherein Z2 represents an impedance (kiloohms) of when the below-mentioned cell is measured at a frequency of 100 Hz, and Z3 represents an impedance (kiloohms) of when the below-mentioned cell is measured at a frequency of 1000 Hz, as measured in the form of a cell in which gold is deposited on the surface of said aluminum substrate over an area of 1 $cm^{-2}$.

Furthermore, the anodically oxidized film should have electric characteristics that satisfy equations, $$C2 \leqq 4 \quad (2)$$

and $$3 \geqq C2/C3 > 1$$

wherein C2 represents a capacitance (nF) when the above-mentioned cell is measured at a frequency of 100 Hz, and C3 represents a capacitance (nF) of when the above-mentioned cell is measured at a frequency of 1000 Hz, as measured in the form of the above-mentioned cell, and should further have electric characteristics that satisfy an equation, $$R2 \geqq 500 \quad (3)$$

wherein R2 represents an AC resistance (kiloohms) when the above-mentioned cell is measured at a frequency of 100 Hz, as measured in the form of the above-mentioned cell.

The present invention is based on the discovery that when a photosensitive material is comprised of a surface-treated aluminum substrate and an organic photosensitive layer formed thereon, the developing sensitivity $\gamma$ of the photosensitive material is affected by particular impedance characteristics of the surface-treated layer, and high developing sensitivity is accomplished when there is selectively employed an aluminum substrate of which the surface-treated layer exhibits particular impedance characteristics that satisfy the equations (1).

FIG. 1 shows developing sensitivities $\gamma$ of photosensitive materials (for details, see Examples appearing later) A, B and C obtained by providing various surface-treated drums A, B and C of aluminum with an organic photosensitive layer.

These photosensitive materials and drums were measured for their AC resistance (kiloohms), capacitance (nF) and impedance (absolute value in kiloohms). The results were as shown in Table 1, Table 2 and Table 3 from which the following interesting facts became obvious.

That is, referring to the columns of the photosensitive material samples A, B and C of Tables 1 and 2, almost no difference is recognized in the electric characteristics, i.e., in the AC resistance and the electrostatic capacitance of these photosensitive materials in spite of the difference in the developing sensitivities shown in FIG. 1.

Referring to the columns of the samples A, B and C without having the photosensitive layer of Tables 1 and 2, on the other hand, there are distinguished differences in the AC resistance and the electrostatic capacitance of these samples A, B and C. If reference is made of Table 3, furthermore, there exists a correlation between the developing sensitivity of the photosensitive materials and the impedance characteristics made up of the AC resistance and the electrostatic capacitance, which is a fact that could never be expected.

TABLE 1

| Measuring Freq. (kHz) | Resistance (kΩ) | | |
|---|---|---|---|
| | Sample A (drum) | Sample B (drum) | Sample C (drum) |
| 0.1 | 731 | 287 | 603 |
| 1.0 | 336 | 121 | 286 |
| 10.0 | 92 | 27 | 65 |
| 100.0 | 12 | 4 | 9 |
| | Sample A (photosensitive material) | Sample B (photosensitive material) | Sample C (photosensitive material) |
| 0.1 | 10300 | 10500 | 10500 |
| 1.0 | 1090 | 1099 | 1095 |
| 10.0 | 110 | 112 | 114 |
| 100.0 | 11 | 11 | 10 |

TABLE 2

| Measuring Freq. (kHz) | Capacitance (nF) | | |
|---|---|---|---|
| | Sample A (drum) | Sample B (drum) | Sample C (drum) |
| 0.1 | 2.7 | 5.3 | 3.3 |
| 1.0 | 1.8 | 3.3 | 1.8 |
| 10.0 | 1.5 | 2.3 | 1.5 |
| 100.0 | 1.3 | 1.6 | 1.3 |
| | Sample A (photosensitive material) | Sample B (photosensitive material) | Sample C (photosensitive material) |
| 0.1 | 151 | 151 | 151 |
| 1.0 | 145 | 145 | 145 |
| 10.0 | 143 | 142 | 142 |
| 100.0 | 141 | 140 | 139 |

TABLE 3

| Measuring Freq. (kHz) | Impedance (kΩ) | | |
|---|---|---|---|
| | Sample A (drum) | Sample B (drum) | Sample C (drum) |
| 0.1(Z2) | 464 | 198 | 349 |
| 1.0(Z3) | 84 | 41 | 73 |
| 10.0 | 10.2 | 5.8 | 9.7 |
| 100.0 | 1.18 | 0.79 | 1.24 |
| Z2/Z3 | 5.52 | 4.83 | 4.72 |

In this specification, the electrostatic characteristics were measured by using the above-mentioned cell using a measuring instrument mentioned below under the conditions described below. That is, measurements were taken using an LCR meter, Model AG-4311B manufactured by Ando Denki Co., Japan while applying a voltage of 5 volts of a sine wave.

In the present invention, it was quite an unexpected discovery that the surface-treated layer of the aluminum substrate having impedance characteristics that satisfy the equations (1) contributed to improving the developing sensitivity. An alumite layer has heretofore been formed on the surface of the drum by anodic oxidation which, however, was simply to improve intimate adhesiveness for the organic photosensitive layer and to prevent the injection of carriers at the time of inversion developing. It had not been known at all the electric characteristics of the Alumite layer affect the developing performance of the electrostatic latent image formed on the surface of the photosensitive layer.

In the present invention, an increase in the developing sensitivity was found as a phemenon from the results of extensive experiments and measurements, but its mechanism has not yet been clarified. However, the present inventors presume this fact as mentioned below.

The surface-treated layer formed on the surface of the substrate by the anodic oxidation is composed of an aluminum oxide or a hydrated oxide ranging from minute structure through up to porous structure. The oxide has a relatively large electric resistance and the hydrated oxide has a relatively small electric resistance yet both have electrostatic capacities as films.

Referring to FIGS. 6A, 6B and 6C which show as equivalent circuits of the surface-treated layer, the layer generally consists, as shown in FIG. 6A, of a circuit in which a capacitance C and a resistance $R_s$ are connected in series and a circuit of a resistance $R_p$ connected in parallel therewith. This circuit can be approximated to a C-R parallel circuit of FIG. 6B on the high-impedance side and can be approximated to a C-R series circuit of FIG. 6C on the low-impedance side. In the case of the high-impedance (low-capacitance) surface-treated aluminum substrate used in the present invention, it is considered that the layer works as a barrier which inhibits the flow of current until the electric charge in the photosensitive layer exceeds a given level at the time of exposure, contributing to improving the developing sensitivity $\gamma$.

DETAILED DESCRIPTION OF THE PREFERRED EMBODIMENTS

Figure 1:
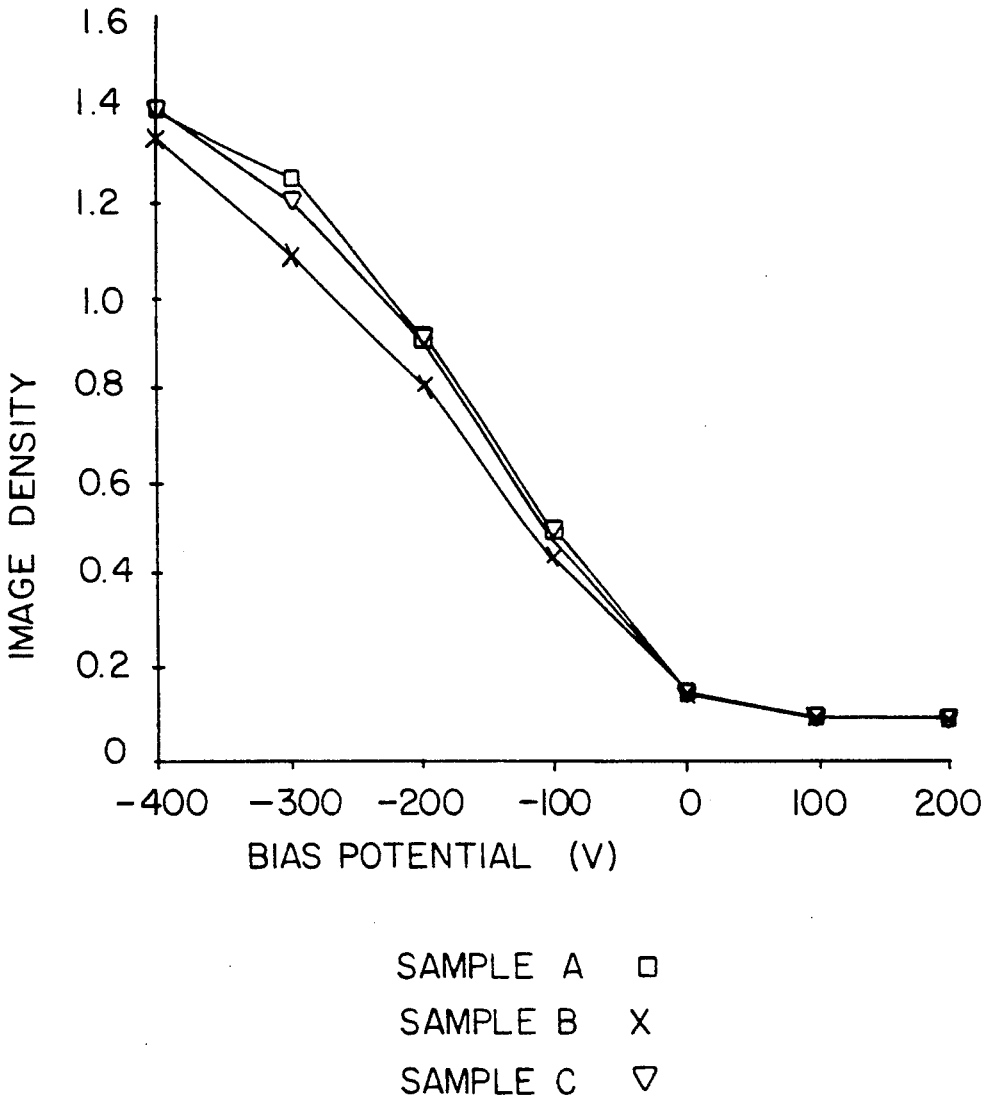
FIG. 1 is a diagram of characteristics showing developing sensitivities of photosensitive materials which are obtained by forming a photosensitive layer of the same recipe on three kinds of drums A, B and C and which are measured under the same system conditions using the same developing agent but changing the image density ID and the bias voltage.

Described below is a preferred embodiment of an organic photosensitive material according to the present invention which comprises an aluminum substrate of which the surface has been treated and an organic photosensitive layer formed on the substrate. The organic photosensitive layer has a charge-generating layer and a charge-transporting layer which may be separated from each other or which are formed as a single layer.

Aluminum Substrate

When used for a photosensitive drum, the substrate is chiefly comprised of an aluminum drum whose surface has been treated such as by anodic oxidation. The surface treatment is carried out by, for example, immersing the aluminum drum which works as a positive pole in an aqueous solution of acid such as oxalic acid, sulfuric acid or chromic acid, and flowing an electric current in order to form an oxide film. By anodically oxidizing the surface layer to form a fine porous layer, it is allowed to improve intimate adhesiveness relative to the photosensitive layer as will be described later as well as to prevent the injection of carriers and to prevent the photoconductive layer from being destroyed by the electric discharge. According to the present invention as described earlier, the surface is so treated as to satisfy the equations (1), and more preferably as to satisfy the equations (2) and (3).

In general, the impedance increases as the Alumite film becomes more minute and, conversely, the impedance decreases as the Alumite film becomes more porous. This is related to a current density at the time of anodic oxidation, and the film tends to become porous when the current density is high. This is related to the time of electrolysis.

Furthermore, if the pores in the Alumite film are sealed after the electrolytic treatment, the film exhibits further increased impedance though it may charge depending upon the conditions of sealing the pores.

Therefore, the thickness, porousness and minuteness of the treated film should be so adjusted as to obtain the above-mentioned impedance characteristics by selecting a current density, a voltage, a time of electrolysis, a temperature of the electrolyte and a concentration of the electrolyte.

In the case of a film using, for instance, sulfuric acid, the conditions that help accomplish the above-mentioned electric characteristics may be selected from a bath filled with sulfuric acid of a concentration of 10 to 18% maintained at a temperature of 15° to 25° C., a current density of 0.5 to 2 A/dm$^2$, and a treating time of about 15 to 45 minutes, though the invention is in no way limited thereto only. Furthermore, the conditions for the pore-sealing treatment should similarly be selected from the water of a temperature of 95° C. up to its boiling point, and the treating time of about 10 to 45 minutes. The thickness of the treated film should generally be over a range of 2 to 20 $\mu$m.

According to the present invention, the value Z2 should be greater than 400 kiloohms but smaller than 600 kiloohms from the standpoint of preventing the fogging, and the value Z2/Z3 should be greater than 4, and particularly, greater than 5 but should be smaller than 7. Moreover, the value C2 should be smaller than 3.5 nF but greater than 1.5 nF. The value R2 should be greater than 650 kiloohms but smaller than one megohms.

Figure 2:
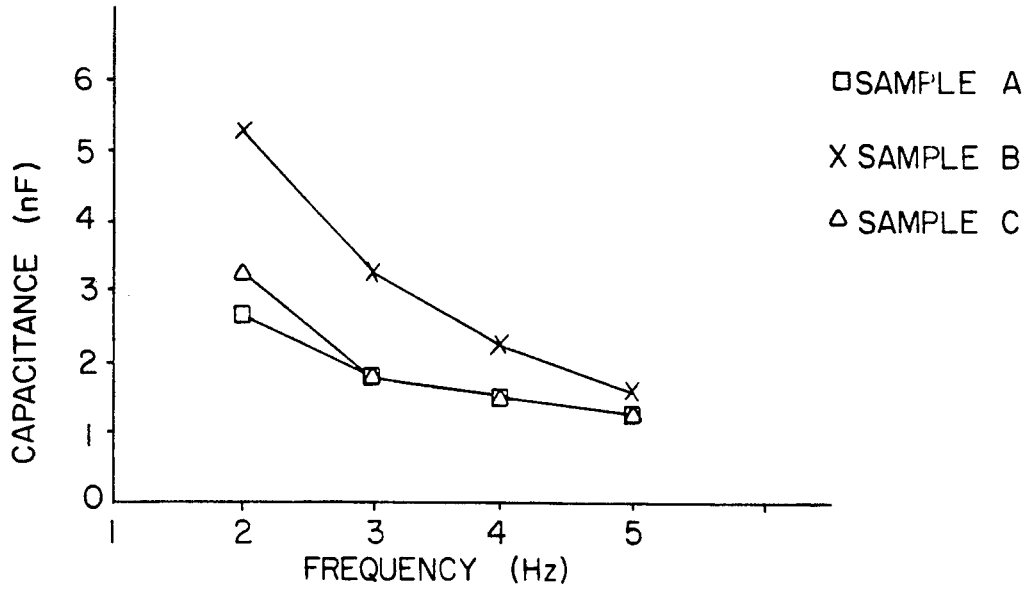
FIG. 2 is a diagram of characteristics showing charges in the capacitances of the drums at 100 Hz (or 2 log Hz) through up to 100,000 Hz (or 5 log Hz)

Here, FIG. 2 is a diagram of characteristics showing changes in the capacitance of the drums depending on the frequencies of 100 Hz (or 2 log Hz) through up to 100,000 Hz (or 5 log Hz).

Organic Photosensitive Layer

The present invention can be adapted to a photosensitive material of the laminated-layer type for electrophotography and to a photosensitive material of the single-layer dispersed type for electrophotography. For instance, a charge-generating layer (CGL) is formed on a surface-treated aluminum drum, and a charge-transporting layer (CTL) is formed on the charge-generating layer. Or, conversely, the charge-transporting layer is formed on the drum, and the charge-generating layer is formed on the charge-transporting layer. It is, further, allowable to form on the drum a single photosensitive layer which is obtained by dispersing the charge-generating material in a charge-transporting medium.

Examples of the charge-generating material include selenium, selenium-tellurium, amorphous silicon, pyrylium salt, azo-type pigment, dis-azo-type pigment, anthanthrone-type pigment, phthalocyanine-type pigment, indigo-type pigment, toluidine-type pigment, pyrazoline-type pigment, perylene-type pigment and guinacridone-type pigment, which can be used in a single kind or being mixed in two or more kinds so as to exhibit absorption wavelength on a described region.

The charge-generating material can be applied in the form of a layer employing such means as vaporization or can be applied in the form of a layer being dispersed in a binder resin. Various kinds of resins can be used as binder resins such as olefin-type polymer, e.g., styrene-type polymer, acrylic-type polymer, styreneacrylic-type copolymer, ethylene-vinyl acetate copolymer, polypropylene, and ionomer, and photocurable resins, e.g., polyvinyl chloride, vinyl chloride-vinyl acetate copolymer, polyester, alkyd resin, polyamide, polyurethane, epoxy resin, polycarbonate, polyacrylate, polysulfone, diallyl phthalate resin, silicone resin, ketone resin, polyvinyl butyral resin, polyether resin, phenol resin, and epoxy acrylate. These binder resins can be used in a single kinds or being mixed in two or more kinds.

Furthermore, widely known charge-transporting materials are used being dispersed in the above binder resin. Examples include stilbene, N,N'-(o,p-dimethylphenyl)-N,N'-(diphenyl)benzidine, 1,1-bis(p-diethylaminophenyl)-4,4-diphenyl-1,3-butadiene, N,N-diethylaminobenzaldehyde-N,N-diphenyl hydrazone, N,N-dimethylaminobenzaldehyde-N,N-diphenyl hydrazone, N-methyl-N-phenylaminobenzaldehyde-N,N-diphenyl hydrazone, 4-diphenylamino-$\alpha$-phenyl stilbene, triphenylamine, and the like.

The layer of the photosensitive material is formed by preparing a coating solution thereof using a widely known solvent and applying it onto the surface of the drum. Even when the organic photosensitive layer is variously changed, the developing sensitivity of the obtained photosensitive material is solely affected by the impedance of the surface of the drum, and no change is observed in the AC resistance and capacitance of the photosensitive material as a whole.

The invention will now be described in further detail by way of examples.

Example 1

Preparation of an electrically conductive substrate.

A drum of pure aluminum was treated under the following anodic oxidation conditions to form an Alumite layer on the surface thereof.

Current density: 1.0 A/dm$^{-2}$
Voltage: 12 V
Electrolytic free sulfuric acid: sulfuric and concentration, 15%
Temperature: 25° C.
Time: 30 minutes The drum was treated in the boiling water of 98° C. for 15 minutes to seal the pores. The thus obtained drum is referred to as drum A (which corresponds to the sample A of Tables 1, 2, 3 and of FIG. 1). Preparation of a photosensitive material for electrophotography.

100 parts by weight of a polyvinyl butyral as a binding resin, 200 parts by weight of an X-type metal-free phthalocyanine as a charge-generating material, and a predetermined amount of dichloromethane were fed into a ball mill, and were mixed together with stirring fir 24 hours to prepare a coating solution for forming a charge-generating layer. The thus prepared solution was applied onto the above drum A that served as an electrically conductive substrate by the immersion method, and was dried by blowing the hot air heated at 110° C. for 30 minutes to cure it, in order to form a charge-generating layer having a thickness of 0.5 μm.

Next, 100 parts by weight of a polycarbonate resin as a binder resin, 100 parts by weight of a diethylaminobenzaldehyde-1,1-diphenyl hydrazone as a charge-transporting material, and a predetermined amount of toluene were mixed together with stirring using a homo-mixer to prepare a coating solution for forming a charge-transporting layer. The coating liquid was applied onto the surface of the charge-generating layer by the immersion processing, and was dried by blowing the hot air heated at 100° C. for 30 minutes to form a charge-transporting layer having a thickness of about 20 μm, in order to prepare a photosensitive material for electrophotography. There was obtained the photosensitive material that corresponded to the photosensitive material sample A of Tables 1 and 2. The photosensitive material exhibited optical attenuation characteristics as shown in Table 4.

Example 2

A photosensitive material for electrophotography was prepared in the same manner as in Example 1 with the exception of using a τ-type metal-free phthalocyanine instead of the X-type metal-free phthalocyanine as a charge-generating material for the coating solution for forming the charge-generating layer. The photosensitive material exhibited the optical attenuation characteristics as shown in Table 5.

Comparative Example 1

Preparation of an electrically conductive substrate.

A drum of pure aluminum was treated under the following anodic oxidation conditions to form an Alumite layer on the surface thereof.

Current density: 2.0 A/dm$^{-2}$
Voltage: 12 V
Electrolytic free sulfuric acid: sulfuric and concentration, 15%
Temperature: 25° C.
Time: 15 minutes The drum was treated in the same manner as in Example 1 to seal the pores. The obtained drum is referred to as drum B (which corresponds to the sample B of Tables 1, 2, 3 and of FIG. 1).

TABLE 4

| | Example 1 | | | | | | | | | | | |
|---|---|---|---|---|---|---|---|---|---|---|---|---|
| LD (nw) | 0 | 0.1 | 0.2 | 0.3 | 0.4 | 0.5 | 0.6 | 0.7 | 0.8 | 0.9 | 1.0 | 1.1 |
| Surface Potential | −680 | −568 | −453 | −360 | −280 | −220 | −166 | −120 | −89 | −70 | −55 | −43 |

TABLE 5

| | Example 2 | | | | | | | | | | | |
|---|---|---|---|---|---|---|---|---|---|---|---|---|
| LD (nw) | 0 | 0.1 | 0.2 | 0.3 | 0.4 | 0.5 | 0.6 | 0.7 | 0.8 | 0.9 | 1.0 | 1.1 |
| Surface Potential | −740 | −568 | −436 | −332 | −270 | −218 | −180 | −158 | −134 | −120 | −108 | −98 |

Developing sensitivity (γ)

Figure 6A:
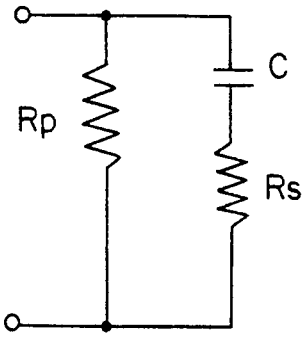
FIGS. 6A, 6B and 6C are diagrams of equivalent circuits of a surface-treated layer of an aluminum substrate employed for the photosensitive materials.
Figure 6B:
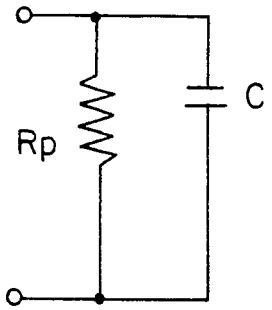
Figure 6C:
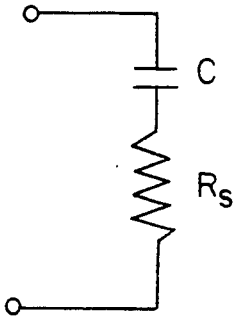

Using an electrophotocopying machine (manufactured by Mita Industrial Co., Ltd. a modified version of LPX2 (using a semiconductor laser as a source of light), copies were obtained while changing the bias potential. Image densities (ID) for each of the bias potentials were measured by using an image densitometer (manufactured by Tokyo Denshoku Co., TC-6D). The results were as shown in Table 5 and FIG. 6.

TABLE 6

| Bias Potential (V) | −400 | −300 | −200 | −100 | 0 | 100 | 200 |
|---|---|---|---|---|---|---|---|
| ID of Examples 1, 2 | 1.405 | 1.300 | 0.992 | 0.582 | 0.164 | 0.099 | 0.09[illegible] |
| ID of Comparative Example 1 | 1.361 | 1.189 | 0.843 | 0.530 | 0.164 | 0.099 | 0.098 |

Figure 3:
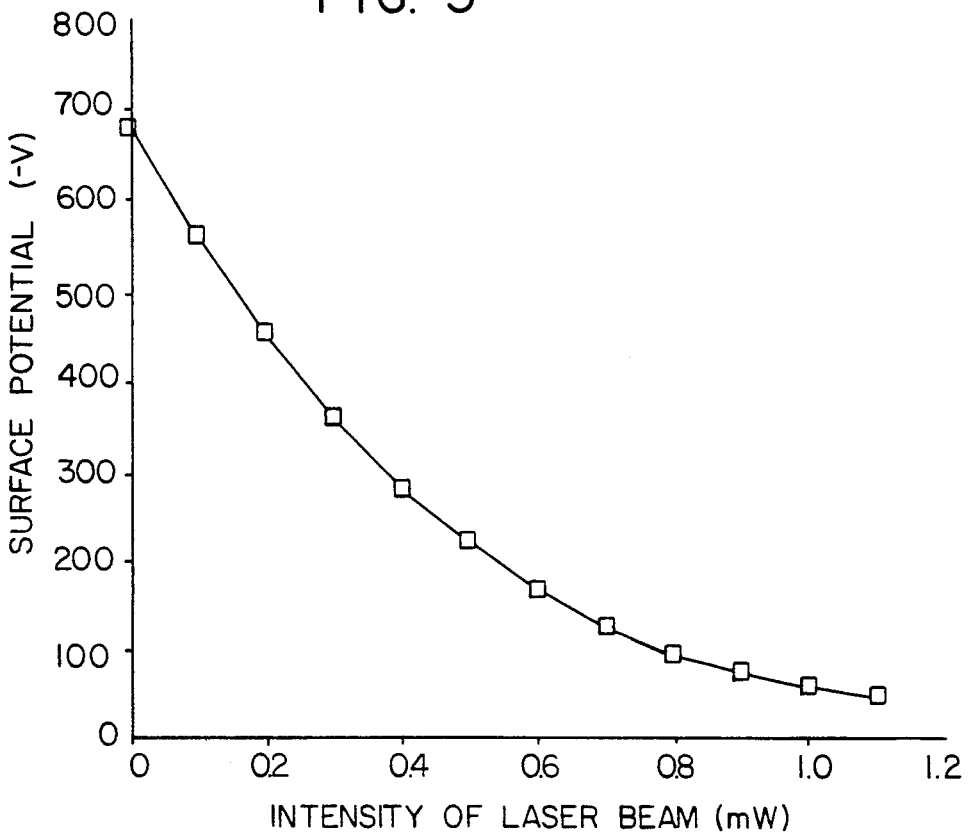
FIG. 3 is a diagram of characteristics showing optical attenuation of photosensitive material.
Figure 4:
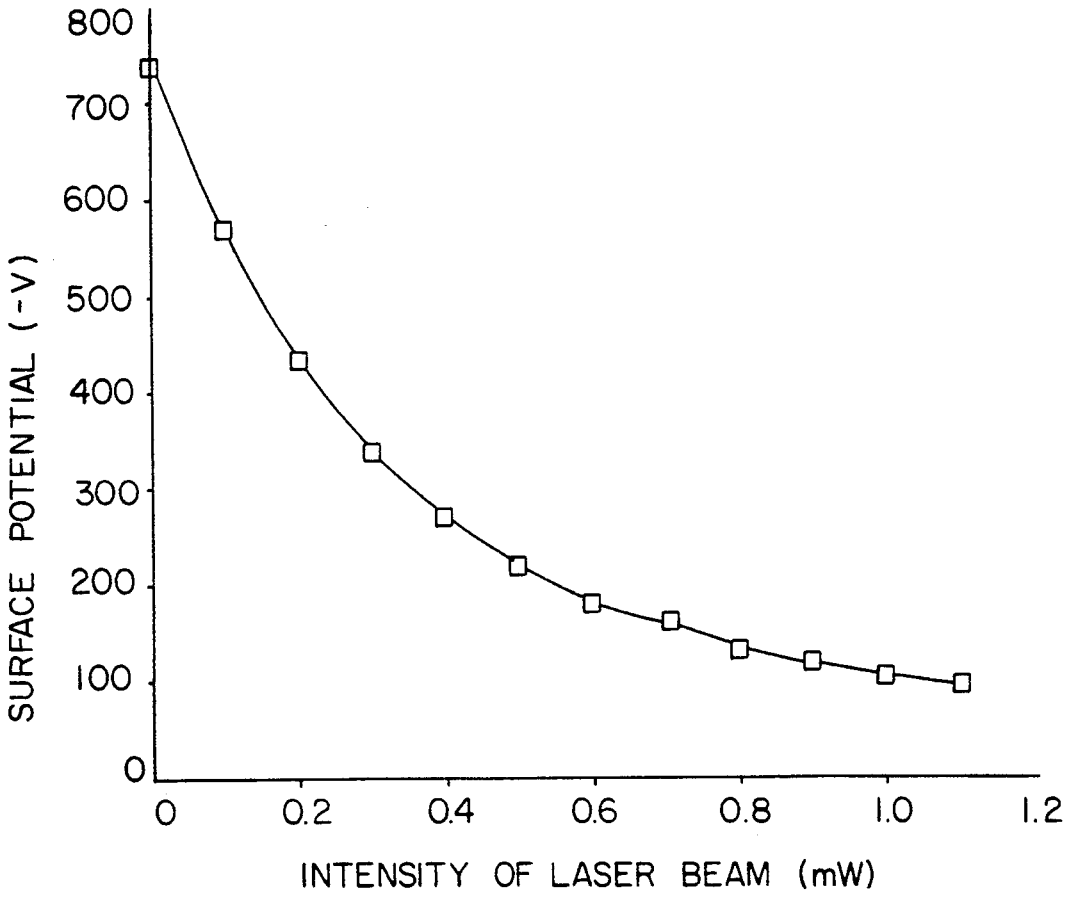
FIG. 4 is a diagram of characteristics showing optical attenuation of a photosensitive material.
Figure 5:
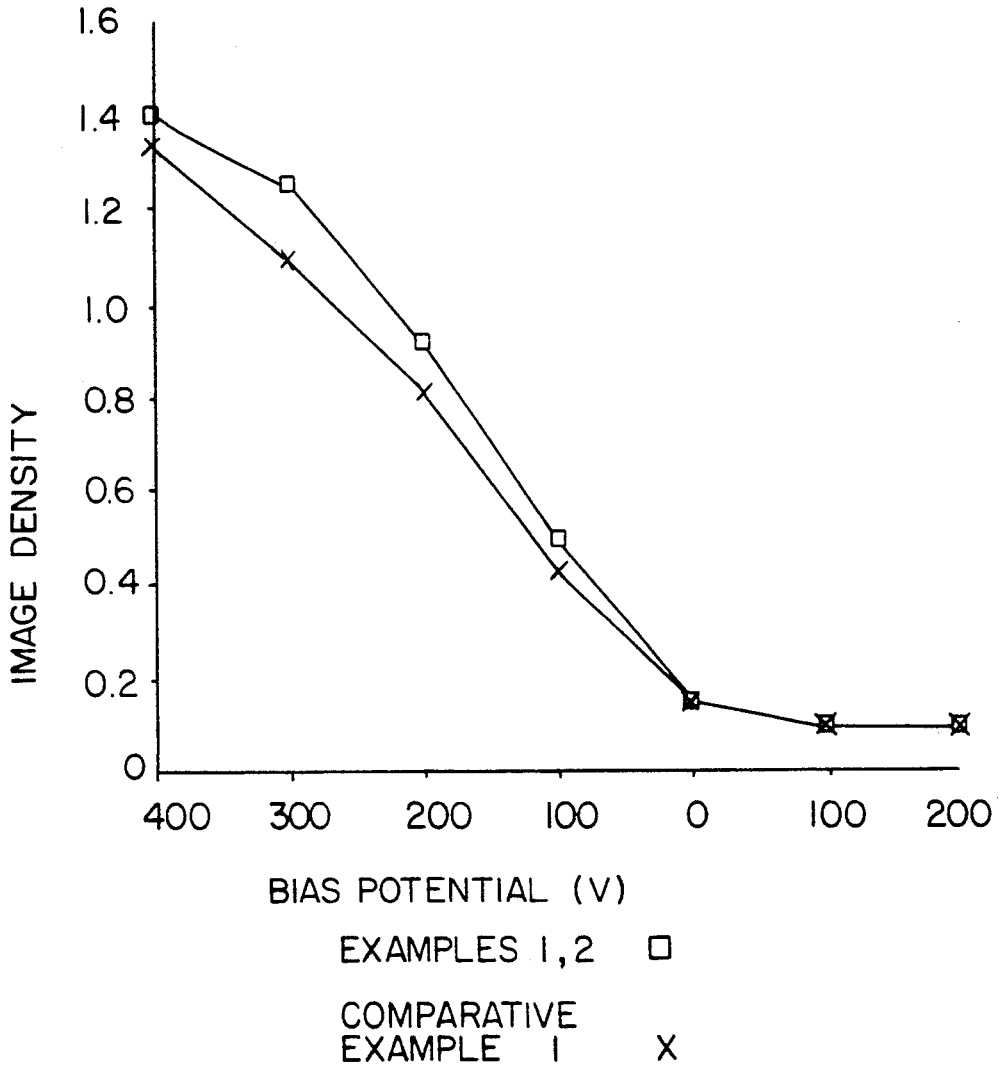
FIG. 5 is a diagram of characteristics showing developing sensitivities of photosensitive materials of the present invention and of photosensitive materials of Comparative Examples.

As will be obvious from FIG. 5, the developing sensitivity is related to the characteristics of the electrically conductive substrate only. It will be recognized that the photosensitive materials for electrophotography of Examples 1 and 2 that use the drum A (AC resistance, capacitance and impedance of the surface of the drum are those of the sample A of Tables 1, 2 and 3) exhibit better developing sensitivities and more favorable copied image densities than those of the photosensitive materials of Comparative Example 1 that used the drum B (AC resistance, capacitance and impedance of the surface of the drum are shown in Tables 1, 2 and 3). From FIGS. 3 and 4, the optical attenuation characteristics of the photosensitive materials for electrophotography are not related to the characteristics of the electrically conductive substrate but are related to the characteristics of the photosensitive layer.

According to the present invention as described above, the surface-treated layer is so formed on the surface of the drum as to exhibit an impedance that lies within a predetermined range, making it possible to enhance the developing sensitivity of the photosensitive member and to sufficiently enhance the density and contrast of the copied image irrespective of the properties of the developing agent and the system conditions.

We claim:

1. An organic photosensitive material for electrophotography comprising an aluminum substrate having an alumite layer and an organic photosensitive layer formed on said alumite layer, wherein said alumite layer has electric characteristics that satisfy equations, $$300 \leqq Z2 \leqq 600$$

and $$3 \leqq Z2/Z3 \leqq 7$$

wherein Z2 represents an impedance (kiloohms) when the below-mentioned cell is measured at a frequency of 100 Hz, and Z3 represents an impedance (kiloohms) when the below-mentioned cell is measured at a frequency of 1000 Hz, as measured in the form of a cell in which gold is deposited on the surface of said aluminum substrate over an area of 1 $cm^{-2}$.

2. A photosensitive material according to claim 1, wherein the alumite layer of said substrate has electric characteristics that satisfy equations, $$C2 \leqq 4$$

and $$3 \geqq C2/C3 > 1$$

wherein C2 represents a capacitance (nF) when said cell is measured at a frequency of 100 Hz, and C3 represents a capacitance (nF) when the above-mentioned cell is measured at a frequency of 1000 Hz, as measured in the form of said cell.

3. A photosensitive material according to claim 1 or 2, wherein the alumite layer of said substrate has electric characteristics that satisfy the equation, $$R2 \geqq 500$$

wherein R2 represents an AC resistance (kiloohms) of when said cell is measured at a frequency of 100 Hz, as measured in the form of said cell.

4. A photosensitive material according to claim 1 or 2, wherein said alumite layer consists of an anodically oxidized film of aluminum having a thickness of 2 to 20 μm.

5. A photosensitive material according to claim 1, wherein the organic photosensitive layer consists of a composition obtained by dispersing a charge-generating material in a charge-transporting medium.

6. A photosensitive material according to claim 1, wherein the organic photosensitive layer consists of a laminate of a charge-generating layer formed on the alumite layer and a charge-transporting layer formed on said charge-generating layer.

7. A photosensitive material according to claim 1, wherein the organic photosensitive material consists of a laminate of a charge-transporting layer formed on the alumite layer and a charge-generating layer formed thereon.

8. A photosensitive material according to claim 3 wherein said surface-treated layer consists of an anodically oxidized film of aluminum having a thickness of 2 to 20 μm.

9. An organic photosensitive material for electrophotography comprising an aluminum substrate having an alumite layer and an organic photosensitive layer formed on said alumite layer, wherein said alumite layer has electric characteristics that satisfy equations, $$400 \leqq Z2 \leqq 600$$

and $$4 \leqq Z2/Z3 < 7$$

wherein Z2 represents an impedance (kiloohms) when the below-mentioned cell is measured at a frequency of 100 Hz, and Z3 represents an impedance (kiloohms) when the below-mentioned cell is measured at a frequency of 1000 Hz, as measured in the form of a cell in which gold is deposited on the surface of said aluminum substrate over an area of 1 $cm^{-2}$.

10. A photosensitive material according to claim 9, wherein the surface-treated layer of said substrate has electric characteristics that satisfy equations, $$3.5 \geqq C2 > 1.5$$

and $$3 \geqq C2/C3 > 1$$

wherein C2 represents a capacitance (nF) when said cell is measured at a frequency of 100 Hz, and C3 represents a capacitance (nF) when the above-mentioned cell is measured at a frequency of 1000 Hz, as measured in the form of said cell.

11. A photosensitive material according to claim 9 or 10, wherein the alumite layer of said substrate has electric characteristics that satisfy the equation, $$650 \leqq R2 < 1000$$

wherein R2 represents an AC resistance (kiloohms) of when said cell is measured at a frequency of 100 Hz, as measured in the form of said cell.

12. A photosensitive material according to claim 9 or 10, wherein said alumite layer consists of an anodically oxidized film of aluminum having a thickness of 2 to 20 μm.

13. A photosensitive material according to claim 9, wherein the organic photosensitive layer consists of a composition obtained by dispersing a charge-generating material in a charge-transporting medium.

14. A photosensitive material according to claim 9, wherein the organic photosensitive layer consists of a laminate of a charge-generating layer formed on the alumite layer and a charge-transporting layer formed on said charge-generating layer.

15. A photosensitive material according to claim 9, wherein the organic photosensitive material consists of a laminate of a charge-transporting layer formed on the alumite layer and a charge-generating layer formed thereon.

16. A photosensitive material according to claim 11, wherein said surface-treated layer consists of an anodically oxidized film of aluminum having a thickness of 2 to 20 μm.

* * * * *